US008150607B2

(12) United States Patent
Kim et al.

(10) Patent No.: US 8,150,607 B2
(45) Date of Patent: Apr. 3, 2012

(54) METHOD AND AN APPARATUS FOR TRANSMITTING AND RECEIVING TRAFFIC INFORMATION BY USING FILE TRANSFER

(75) Inventors: Jun Kim, Seoul (KR); Kyoung Soo Moon, Seoul (KR); Sang Hyup Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 980 days.

(21) Appl. No.: 11/917,329

(22) PCT Filed: Jun. 2, 2006

(86) PCT No.: PCT/KR2006/002129

§ 371 (c)(1), (2), (4) Date: May 28, 2008

(87) PCT Pub. No.: WO2006/135161

PCT Pub. Date: Dec. 21, 2006

(65) Prior Publication Data

US 2008/0249700 A1 Oct. 9, 2008

(30) Foreign Application Priority Data

Jun. 13, 2005 (KR) ..... 10-2005-0050411

(51) Int. Cl.
*G06G 7/76* (2006.01)

(52) U.S. Cl. ..... 701/117

(58) Field of Classification Search ..... 701/117; 455/3.01–3.06, 414.1–414.4, 415, 425, 517, 455/70, 72, 90.1, 345; 707/627, 628; 340/991, 340/992, 993, 14.1

See application file for complete search history.

(56) References Cited

U.S. PATENT DOCUMENTS

| | | | | |
|---|---|---|---|---|
| 5,570,361 | A | 10/1996 | Norizuki et al. | |
| 6,618,388 | B2 * | 9/2003 | Yip et al. | 370/401 |
| 6,813,503 | B1 * | 11/2004 | Zillikens et al. | 455/457 |
| 6,963,725 | B2 * | 11/2005 | Kato | 455/3.04 |
| 7,593,999 | B2 * | 9/2009 | Nathanson | 709/217 |
| 7,673,072 | B2 * | 3/2010 | Boucher et al. | 709/245 |
| 2005/0033506 | A1 * | 2/2005 | Peterson | 701/117 |
| 2005/0278637 | A1 * | 12/2005 | Youm et al. | 715/730 |

FOREIGN PATENT DOCUMENTS

| | | | |
|---|---|---|---|
| KR | 10-1997-0022886 | A | 5/1997 |
| KR | 10-2001-0053697 | A | 7/2001 |
| KR | 10-2004-0006165 | A | 1/2004 |
| KR | 10-2006-0021727 | A | 3/2006 |

* cited by examiner

*Primary Examiner* — Mark Beauchaine

(74) *Attorney, Agent, or Firm* — Birch, Stewart, Kolasch & Birch, LLP

(57) ABSTRACT

A method for providing traffic information. The method includes providing information including an object of a first type having a file including the traffic information and an object of a second type including information about the file and information about a service provider providing the file.

20 Claims, 8 Drawing Sheets

*Version.txt*

```
1.2.3 0 0
2.3.4 7 1
2.3.5 8 0
2.3.6 2 0
```

METHOD AND AN APPARATUS FOR TRANSMITTING AND RECEIVING TRAFFIC INFORMATION BY USING FILE TRANSFER

The present application is a National Stage Application of PCT/KR2006/002129 filed on Jun. 2, 2006, and claims priority to Korean Application No. 10-2005-0050411, filed in Korea on 13, 2005, the entire contents of which are incorporated by reference in their entirety.

BACKGROUND OF THE INVENTION

1. Field of the Invention

The present invention relates to a method and an apparatus for obtaining and providing road traffic information.

2. Background Art

With the advancement in digital signal processing and communications technology, radio and TV broadcasts are in the process of being digitized. In addition, a digital broadcast can provide various information as well as audio and video contents, such as news, stock, weather, traffic information, etc. are a few examples.

In particular, the necessity for traffic information is constantly increasing with the increased number of vehicles in downtown areas, the number of vehicles during holidays, and so on. Accordingly, methods for providing traffic information as auxiliary information via a satellite or terrestrial broadcast are under development.

In addition, traffic information requires a standard format, because traffic information receiving terminals made by different manufacturers need to be able to receive and interpret the broadcast traffic information in the same way.

SUMMARY OF THE INVENTION

Accordingly, one object of the present invention is to provide a method and apparatus for providing drivers with useful traffic information via file transfer.

To achieve these and other advantages and in accordance with the purpose of the present invention, as embodied and broadly described herein, the present invention provides in one aspect a method for providing traffic information via file transfer. The method includes transmitting a file containing traffic information configured as an object of a first type, and information about a traffic information service and the file as an object of a second type.

In another aspect, the present invention provides a method for receiving traffic information including extracting a file containing traffic information from at least one received object of a first type and extracting information about a traffic information service and information about each file from a received object of a second type, and based on the extracted information about the traffic information service, determining a decodability of the traffic information embedded in each file and based on the extracted information about each file, determining each file from among the extracted files either to be decoded for utilizing traffic information or to be used for updating traffic information.

In one embodiment of the present invention, a file containing traffic information having traffic congestion information is transmitted using the MOT (Multimedia Object Transfer) protocol.

In another embodiment the object of the first type includes a header core and header extension, and the object of the second type does not contain a header core and header extension.

In yet another embodiment of the present invention, the object of the second type includes a directory extension containing at least one parameter and directory entries as many as the number of associated objects of the first type, in which the directory entry contains the MOT header that is a duplicate of the header core and header extension embedded in the object of the first type.

In still another embodiment of the present invention, one parameter of the directory extension contains version information about a service configuration format, sync information specifying a time for synchronizing traffic information DB, and type information about transmitted files (e.g., information indicating the file is either binary data or markup language data).

In another embodiment of the present invention, the header extension of each MOT header contains a parameter for delivering transmitter-side DB version information of a file carried by an associated object and a parameter for delivering a name of a file carried by an associated object.

In still another embodiment of the present invention, a filename includes an ID assigned to a service provider or contents provider, service component identifier, digits corresponding to file number, and delimiters thereof.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings, which are given by illustration only, and thus are not limitative of the present invention, and wherein.

DETAILED DESCRIPTION OF THE INVENTION

Hereinafter, according to the present invention, preferred embodiments will be described in detail with reference to appended drawings.

Figure 1:
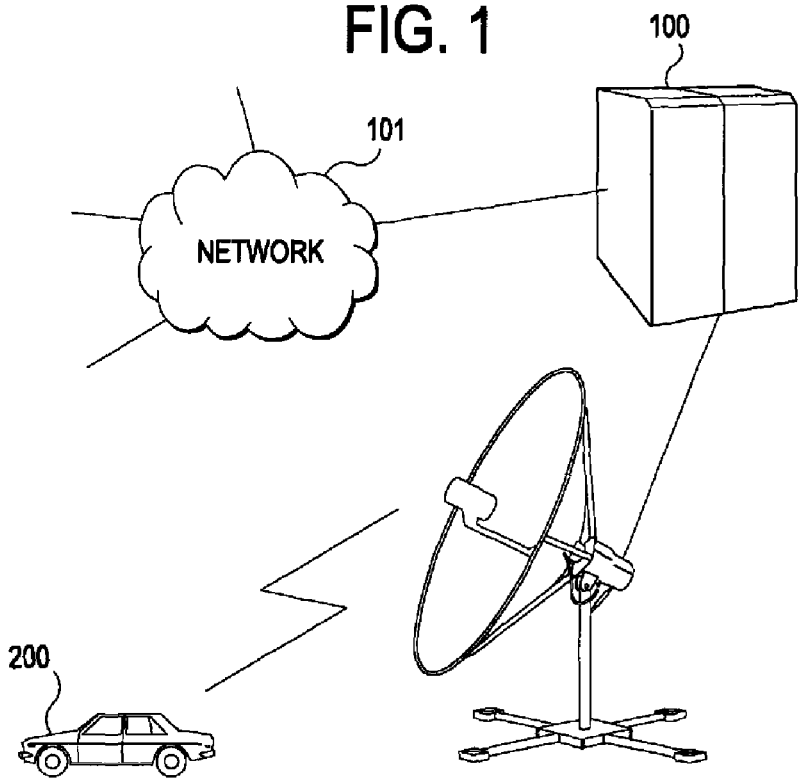
FIG. 1 is a schematic diagram illustrating a network through which traffic information is provided in accordance with an embodiment of the present invention.

First, a method for wirelessly providing traffic information in accordance with an embodiment of the present invention will be described. FIG. 1 is a schematic diagram of a system through which traffic information in accordance with an embodiment of the present invention is provided. As shown, the system includes a traffic information providing server 100 in a broadcast station, and which reconfigures traffic information collected from various sources (e.g., an operator input, information received from another server through a network 101 or probe cars) and wirelessly transmits the information so that a traffic information receiving terminal (e.g., a navigation apparatus) installed in a car 200 can receive the traffic information.

Figure 2:
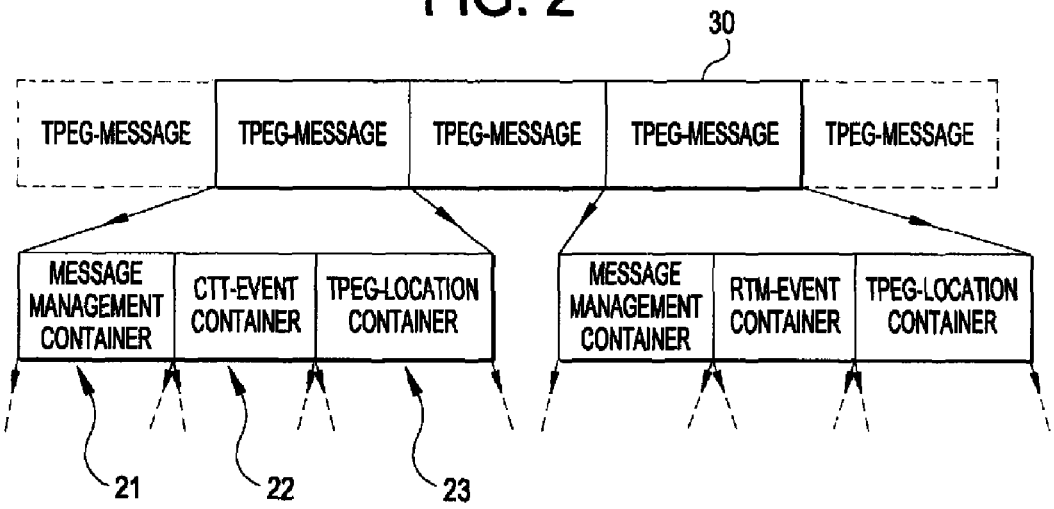
FIG. 2 is an overview illustrating a provision format of traffic information transmitted wirelessly.

As shown in FIG. 2, a format of traffic information wirelessly transmitted from the traffic information providing server 100 includes a sequence of message segments (hereinafter, a message segment is referred to as a TPEG (Transport Protocol Export Group) message). One message segment of the sequence (e.g., a TPEG message containing CTT (Congestion and Travel-Time) information, which is referred to as a TPEG-CTT message) includes a message management container 21, a CTT event container 22, and a TPEG location container 23.

The CTT event container 22 contains information about a traffic congestion status and the sequence may also include traffic information other than the CTT event (e.g., a TPEG message 30 for transmitting road traffic information). Further, the message management container 21 contains information about the current date and time, the message occurrence time, etc. In addition, the CTT event container 22 contains current congestion status information of each link (road segment), including an average speed, travel time, delay time, and degree of congestion in a link. The TPEG location container 23 contains location information about the link.

In addition to the traffic congestion information, a variety of other road traffic information can be provided in the format as shown in FIG. 2 and traffic information can also be provided via a file transfer. In one embodiment according to the present invention for providing traffic information via file transfer, a TPEG.txt, a Version.txt, and a file containing traffic information such as either a '*.bin' file (when traffic information is provided by binary data) or an '*.xml' file (when traffic information is provided by markup language) are used to deliver traffic information such as the CTT information. Information other than the CTT information, e.g., RTM information, can also be included.

Figure 3A:
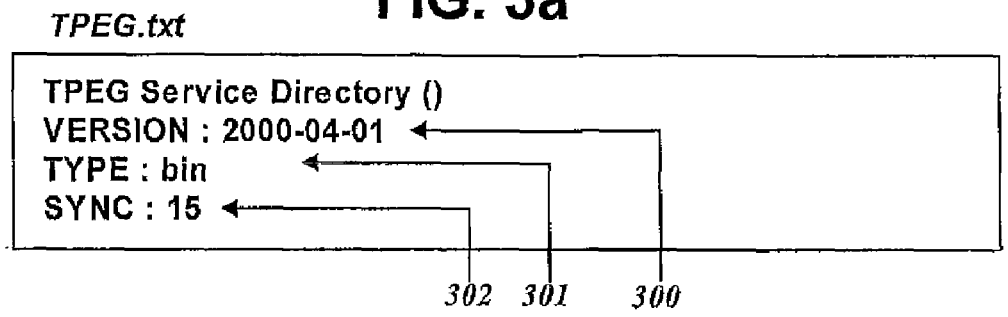
FIG. 3*a* is an overview illustrating an example of information recorded in TPEG.txt that is used for transmitting traffic information in a file.

Next, FIG. 3*a* illustrates an example of information recorded in TPEG.txt. As shown, the TPEG.txt includes version information 300 about a configuration format for a traffic information service (note the information is recorded in the form of "yyyy-mm-dd"), type information 301 about traffic information data carried by a file (binary data or xml script), and sync information 302 that defines the minimum time in units of minute to keep consistency between the transmitter and receiver-side traffic information DB.

Figure 3B:
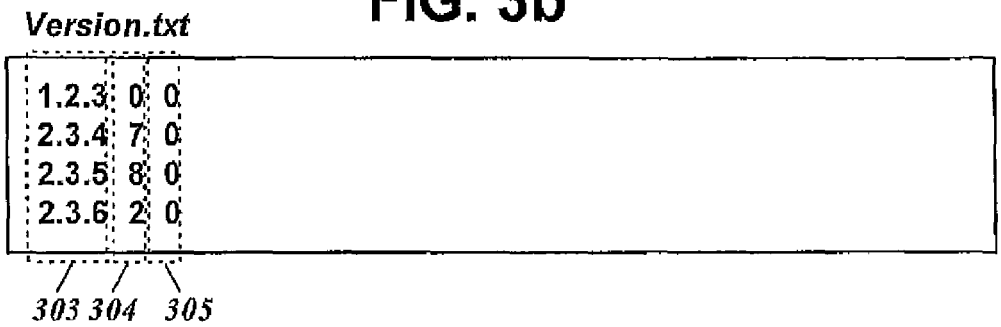
FIG. 3*b* is an overview illustrating an example of information recorded in Version.txt for delivering information about traffic information files.

FIG. 3*b* illustrates an example of Version.txt. As illustrated in FIG. 3*b*, the Version.txt records information about a file carrying traffic information, in which the information includes a service identifier (SID) 303 for each file transfer (note the identifier is designated by SID-A.SID-B.SID-C), a service component ID (SCID) 304, and a transmitter-side DB number 305. FIG. 3*b* illustrates the situation in which four traffic information files are being transmitted.

Figure 3C:
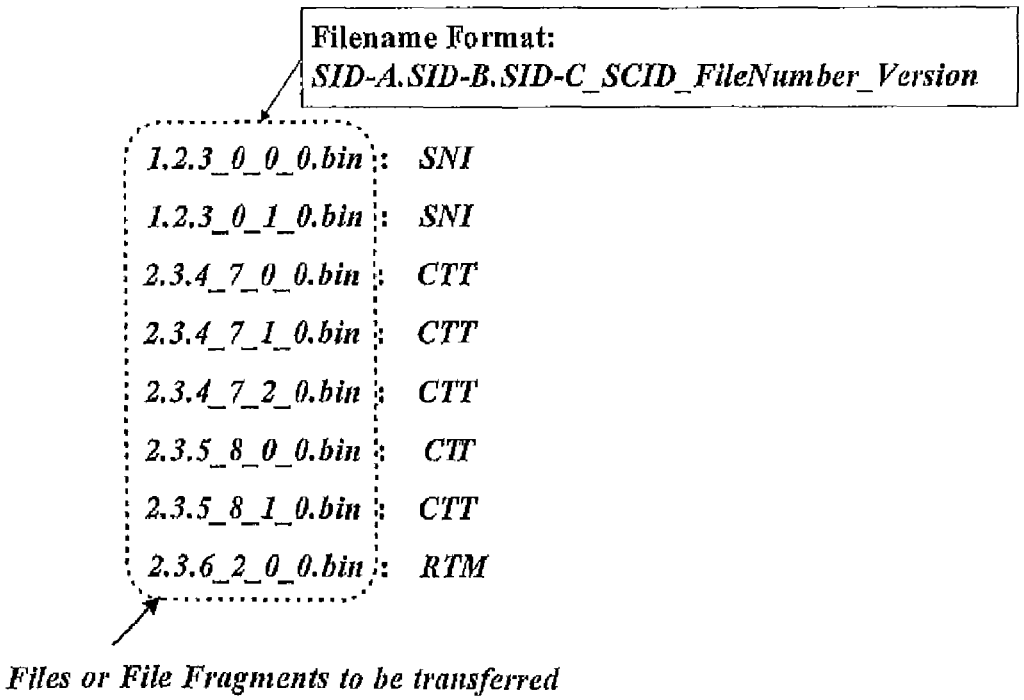
FIG. 3*c* is an overview illustrating a series of files containing traffic information transmitted according to information stored in the Version.txt of FIG. 3*b;*

Further, as illustrated in FIG. 3*c*, the name o a file carrying traffic information (*.bin, *.xml) is designated in the form of SID-A.SID-B.SID-C_SCID_FileNumber_Version, including the ID assigned to a service provider or contents provider, the service component ID, the file number, digits corresponding to the DB number, and delimiters ('_') thereof. In addition, except for FileNumber element, each name of a file is the same as information about the file contained in Version.txt.

In addition, the FileNumber element is intended for recording the sequential number of a file fragment when the original file is partitioned by the server 100 so as to be appropriate for file transfer (e.g., via the MOT protocol). The MOT protocol treats each file fragment as a single file (a file is encapsulated into an object), and when an MOT decoder at the receiver side decodes and delivers each object to an upper application, the application integrates the file segments into a single file and interprets the traffic information contained in the file.

FIG. 3*c* also illustrates a series of files carrying traffic information, in which the files are transmitted in accordance with the information stored in the Version.txt in FIG. 3*b*. As shown in FIG. 3*c*, a broadcast station having an SID of 1.2.3 (SCID is 0 by default) transmits a file carrying service and network information (SNI) by partitioning the file into two file fragments and a contents provider having an SID of 2.3.4 (SCID=7) transmits traffic congestion information using three file fragments.

Figure 3D:
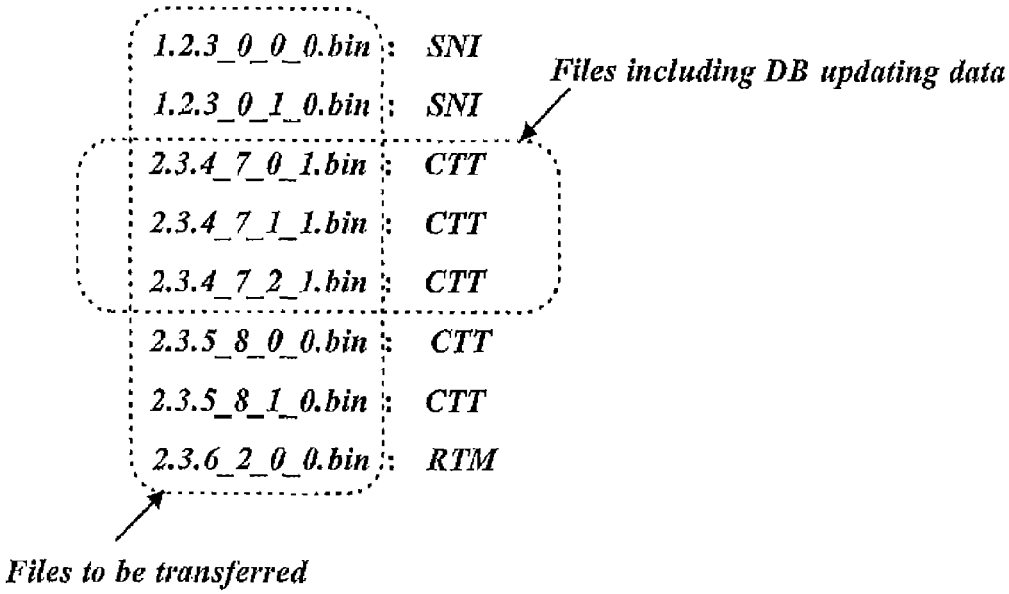
FIG. 3*d* is an overview illustrating information contained in the Version.txt and a series of files transmitted in accordance therewith when a contents provider transmits updated traffic information.

In addition, to transmit updated traffic information after the traffic information has been provided, the DB number in the filename of a file having the updated traffic information, is incremented. For example, FIG. 3*d* illustrates information stored in the Version.txt, the files transmitted in accordance therewith, and the corresponding names when a contents provider (SCID=7) having the SID of 2.3.4 transmits updated traffic information. In comparison with the information in FIG. 3*b*, the numerals 2.3.4_7_0_0 has been changed to 2.3.4_7_0_1, (i.e., the information regarding the version information has been changed from 2.3.4_7_x_0.bin to 2.3.4_7_x_1.bin).

Further, the traffic information file contains traffic information in binary data that is transmitted in the form of a message sequence as shown in FIG. 2, and several data that are used for the frame structure carrying a message sequence can be removed in the file transfer framework. For instance, the frame sync word can be removed, because it is unnecessary for file transfer. Likewise, the frame size can also be removed, because the file size is transmitted instead. In addition, the SID, SCID and frame type can also be removed, because they are transmitted by already being included in a file name. The CRC data of the frame header can also be removed, because the error correction is performed in accordance with the file transfer protocol.

Figure 4:
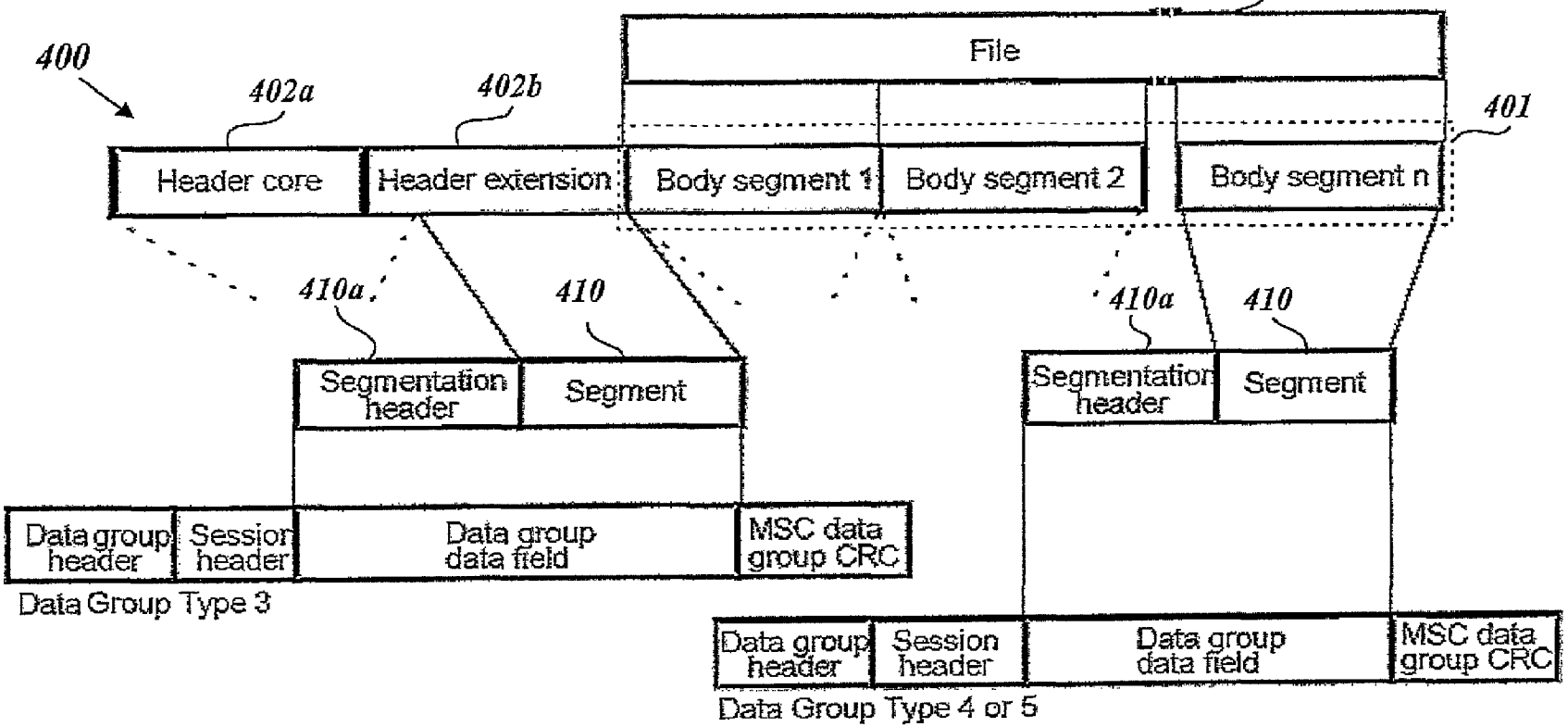
FIG. 4 is an overview illustrating the MOT (Multimedia Object Transfer) protocol format through which each file containing traffic information is transmitted.

Next, FIG. 4 illustrates a transfer format when each file (or each file fragment) containing traffic information such as the aforementioned TPEG.txt, Version.txt, or binary data files (*.bin) is transmitted via file transfer (e.g., using the MOT protocol). Further, the MOT protocol is only one example for file transfer, and the files containing traffic information can be transmitted using another method from among various protocols defined for file transfer. Therefore, the present invention is not limited to the invention being based only on the MOT protocol.

As illustrated in FIG. 4, a file or file fragment 40 is transmitted as an object 400, which includes a body 401 where the file or file fragment 40 is contained, a header core 402*a* and a header extension 402*b* located ahead of the body. In addition, the object 400 is partitioned and transmitted in units of a segment. Also, a segment header 410*a* containing information such as the segment size is supplemented to each segment 410, and each segment 410 and its header 410*a* are transmitted by being carried in a data group.

Further, the data belonging to the header core and extension 402*a*, 402*b* and the data belonging to body 401 are partitioned so that they are not intermixed in the same segment. That is, a segment originating from the header is transmitted by being carried in a data group designated as type 3, whereas a segment from the body is carried in a data group of type 4 or 5.

Figure 5:
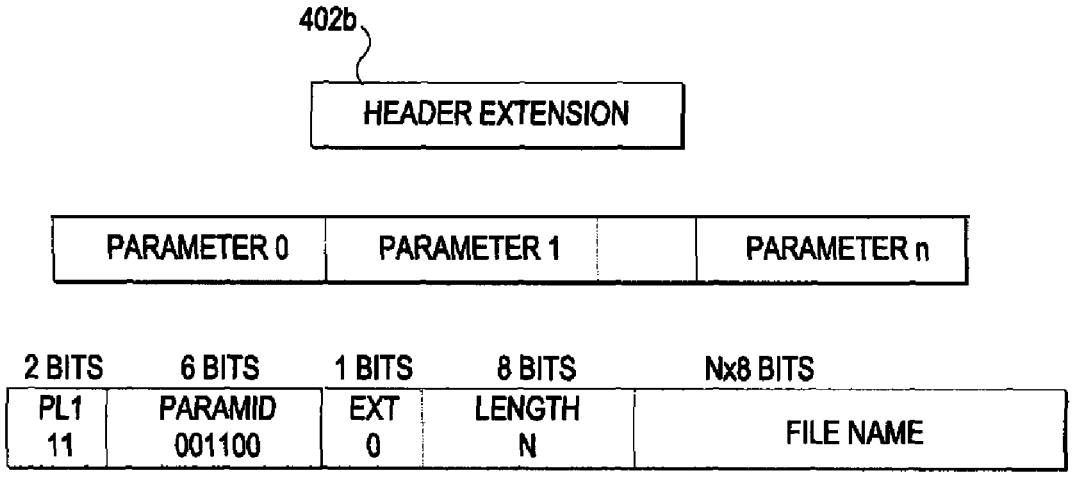
FIG. 5 is an overview illustrating a structure of a parameter contained in a header extension for transmitting a filename.
Figure 6:
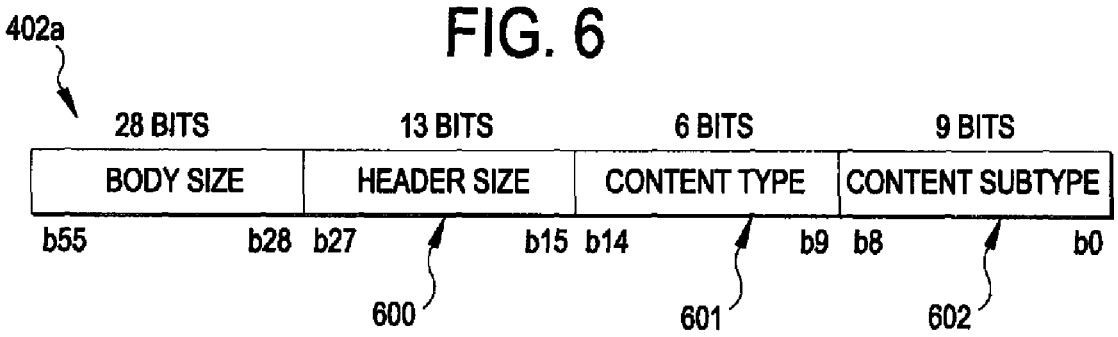
FIG. 6 is an overview illustrating a structure of header core in an object.

In addition, the filename of each file that is carried by the body 401 is transmitted and contained in a parameter as shown in FIG. 5. The size of the entire header including the header extension is recorded in 13-bits of a HeaderSize 600 field within the header core 402*a* having the structure as illustrated in FIG. 6. As shown in FIG. 6, the 6-bits of a ContentType 601 field within the header core 402*a* carries a value indicating a contents type 602 of a succeeding body, namely, a value indicating traffic information such as '111110'.

Accordingly, a MOT decoder that receives the MOT streams transmitted in the form as shown in FIGS. 4 to 6 reconstructs the data contained in the body of each object into files having filenames as specified in the header extension, namely, TPEG.txt, Version.txt, and binary data files (*.bin) as shown in FIG. 3*c*. Subsequently, an application utilizing the traffic information (i.e., an application equipped with a TPEG decoding function) determines the decodability of the traffic information contained in the binary data files based on the version information in the extracted TPEG.txt.

Further, the application determines each file from among reconstructed files either to be decoded for utilizing the traffic information or to be used for updating pre-interpreted traffic information based on information about each file contained in the Version.txt. In addition, according to a specific function, the application equipped with the TPEG decoding function can include both a TPEG-CTT decoding module for decoding traffic congestion information and a TPEG-RTM decoding module for decoding road traffic information (RTM event information), or may include either of the two.

Figure 7:
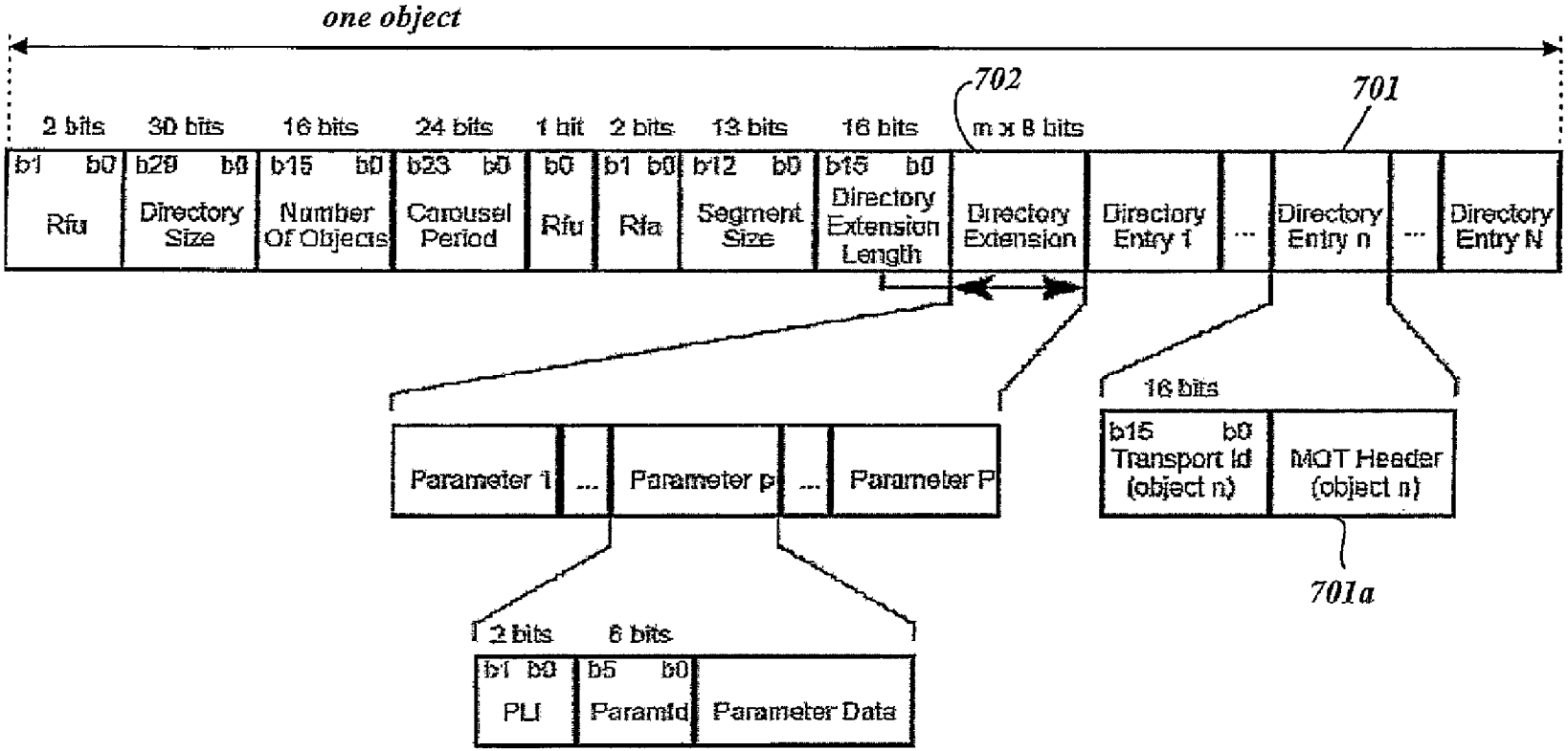
FIG. 7 is an overview illustrating a structure of the MOT directory in accordance with an embodiment of the present invention for transmitting information about a file where traffic information is recorded.

In one preferred embodiment for providing traffic information via file transfer in accordance with the present invention, the information described to be transmitted through TPEG.txt and Version.txt in the previous embodiment is transmitted using the MOT directory having a structure shown in FIG. 7. Further, the MOT directory is transmitted as an object different from an object for file transfer.

In addition, the MOT directory dose not contain a header differently from the object 400 for file transfer, but contains a group of directory entries 701, each of which contains a MOT header 701*a* that is a duplicate of the header core and extension 402*a*, 402*b* of the object carrying each file containing traffic information. The directory entry group includes directory entries corresponding to respective objects contained in a carrousel that is a unit for carrying a set of associated files.

The MOT directory also contains a directory extension 702 where parameters commonly applicable to all of the objects associated by directory entries are recorded. Also, each segment partitioned from the MOT directory is transmitted, by being carried in a data group designated as type 6. Therefore, in the present embodiment, the information transmitted in the TPEG.txt in the previous embodiment is transmitted through one or more than one parameter in the directory extension 702, and the information about each traffic information file carried by the Version.txt is transmitted by being recorded to each directory entry (i.e., by duplicating the header information of an object carrying a corresponding file).

Figure 8A:
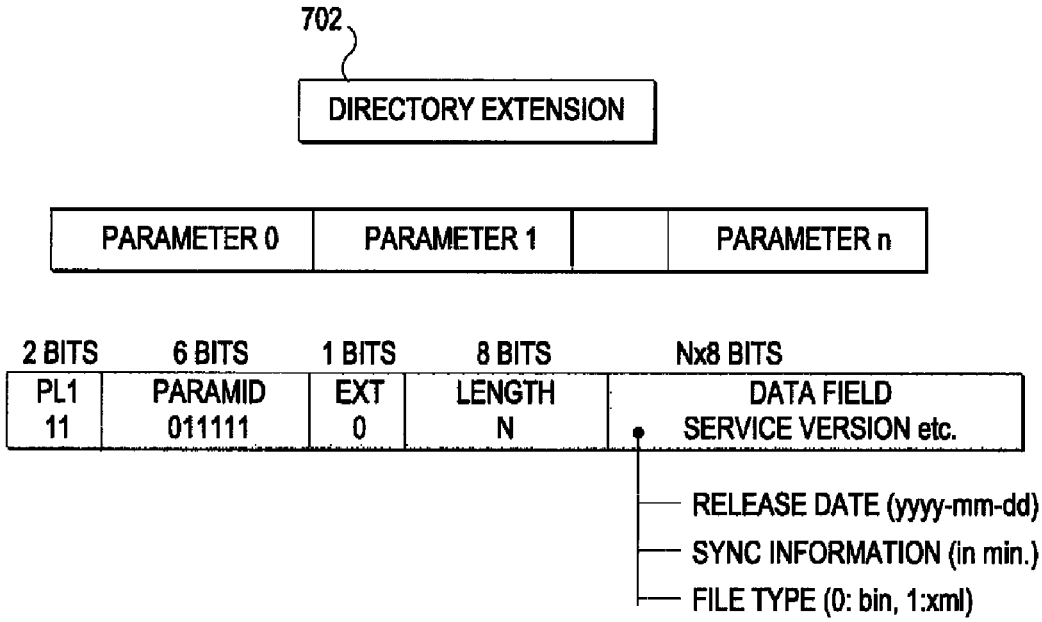
FIG. 8*a* is an overview illustrating a structure of a parameter contained in a directory extension of FIG. 7 according to an embodiment of the present invention, in which the parameter carries version information about a service configuration format, synchronization information, and type information about transmitted files.

Next, FIG. 8*a* illustrates a structure of a parameter contained in the directory extension 702 in FIG. 7, in which the parameter carries version information about the service configuration format, sync information, and type information about transmitted files. In more detail, FIG. 8*a* shows a parameter of the same structure as that in FIG. 5. In addition, the data field of a parameter includes the version (which is expressed in the form of "yyyy-mm-dd"), the sync information (a value expressed in units of minute), and a value that indicates whether the file type is binary data or markup language data.

Further, as a parameter ID indicating that the values are recorded, a value of "011111" is assigned to the parameter. The data field is extracted by the MOT decoder at the receiver and interpreted by a traffic information application (e.g., a TPEG decoder). In addition, for each directory entry, one parameter of the MOT header 701*a* duplicated from the header of the object carrying a file records the transmitter-side DB version information of a file associated with the object.

Figure 8B:
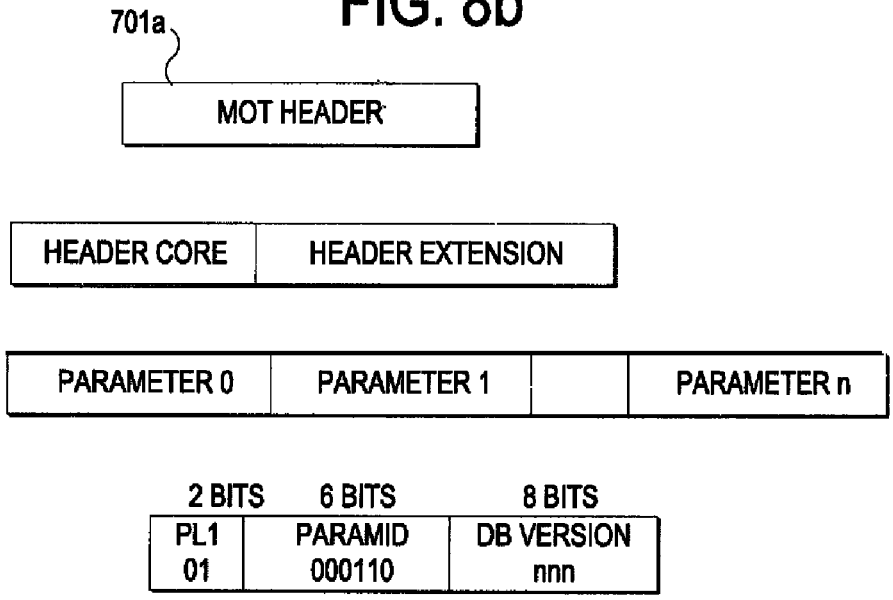
FIG. 8*b* is an overview illustrating a structure of a parameter contained in the MOT header of FIG. 7 according to an embodiment of the present invention, in which the parameter carries transmitter-side DB version about traffic information stored in a file.

FIG. 8*b* shows a structure of such a parameter that transmits the DB version. In addition, because the version information of the traffic information DB contained in a file (a circulating value that ranges between 0 and 255) is carried by a parameter, each filename is designated in the format of SID-A.SID-B.SID-C_SCID_FileNumber. That is, each filename includes an ID assigned to a service provider or contents provider, a service component ID, digits corresponding to file the number, and delimiters ('_') thereof.

The filename is also carried with the structure in FIG. 5 in the MOT header of the directory entry 701*a* of the MOT directory having the structure of FIG. 7. In addition, when a MOT decoder that receives the MOT stream containing the MOT directory of FIG. 7 parses the directory extension 702 and the MOT headers 701*a* within the MOT directory, an application for traffic information, namely, an application equipped with a TPEG decoding function (i.e., an application that decodes CTT and RTM information), determines the decodability of the traffic information contained in a binary data file based on the version information of the service configuration format within the directory extension 702. Further, the application determines each file either to be decoded for utilizing traffic information or to be used for updating pre-interpreted traffic information from among files that the MOT decoder has extracted from the body of each object based on the information about respective files embedded in each MOT header 701*a*.

It is also possible that the service ID (SID) for a provider who provides the service or contents of the traffic information, the service component identifier (SCID), and information about a file sequence are embedded in separately defined parameters and inserted in the header extension 402*b* of each object and then transmitted (note that in an embodiment where the MOT directory is transmitted, the information of the header extension is also transmitted via each directory entry 701). Further, the filename to be transmitted can be arbitrarily assigned. In this instance, a traffic information application does not have to parse the filename of a received file. In addition, the data in a file can be transmitted using one of commonly known data compression methods.

Figure 9:
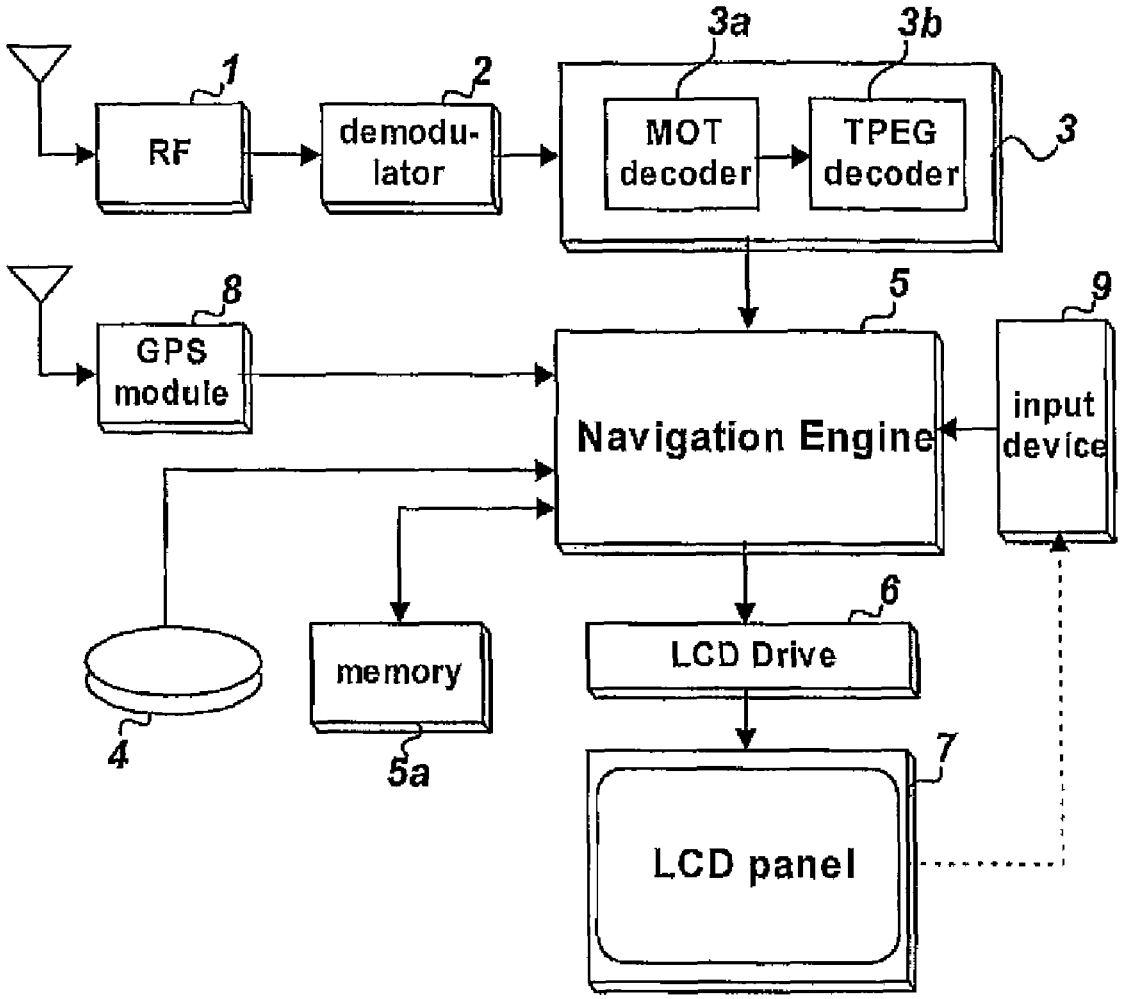
FIG. 9 is a block diagram of a navigation terminal that receives traffic information transmitted via file transfer in accordance with one embodiment of the present invention.

Next, FIG. 9 is a block diagram of a navigation terminal that receives traffic information transmitted from the server 100 via file transfer in accordance with one embodiment of the invention. As shown in FIG. 9, the navigation terminal includes a tuner 1 resonating at a used frequency band for receiving traffic information signals, a demodulator 2 for outputting traffic information signals embedded in the resonated frequency band, and a decoder 3 for obtaining traffic information by decoding the demodulated traffic information signals.

The navigation terminal also includes a GPS module 8 for calculating the current position (i.e., latitude, longitude, and altitude) by receiving signals from a plurality of satellites, a storage unit 4 for storing various graphic data and an electronic map including information on links and nodes, an input unit 9 for receiving user input, a navigation engine 5 for controlling a screen display based on the user input, the current position, and obtained traffic information, a memory 5*a* for temporarily storing data, an LCD panel 7 for displaying data, and an LCD driver 6 for driving the LCD panel 7 according to data to be presented.

Further, the input unit 9 may be a touch screen incorporated into the LCD panel 7, and the decoder 3 includes a MOT decoder 3*a* and a TPEG decoder 3*b*. In addition, when MOT streams are transmitted in the form as shown in FIGS. 4 to 6, the TPEG.txt, Version.txt, and traffic information files in a format of binary data or markup language are extracted from each object using the MOT decoder 3*a*, which are delivered to the succeeding TPEG decoder 3*b*. The TPEG decoder 3*b* then determines the decodability of the traffic information in the binary data (or markup language data) file based on the version and file type information embedded in the extracted TPEG.txt.

The TPEG decoder 3*b* also determines each file either to be decoded for utilizing the traffic information or to be used for updating pre-interpreted traffic information from among the extracted files based on each file information embedded in the Version.txt, and in which the traffic information in the determined file (a merged file from file fragments when the determined files are file fragments) is interpreted in accordance with the identified file type information. Then, depending on the contents, the traffic information in a file is decoded and interpreted by a corresponding decoding module in the TPEG decoder 3*b*.

For example, the CTT information is decoded by the TPEG-CTT decoding module, whereas the RTM event information is decoded by the TPEG-RTM decoding module. In addition, when the TPEG decoder 3*b* can only handle one particular type (e.g., the CTT information), the files carrying traffic information of different types other than the CTT information are ignored.

Further, received data and extracted file data are temporarily stored in the memory 5*a* until the traffic information is completely decoded. When the data of a received file contains compressed data, the TPEG decoder 3*b* runs a particular application, thereby reconstructing the original uncompressed data from the compressed data.

Also, when the MOT streams are transferred in the form as shown in FIGS. 4 to 7, the MOT decoder 3*a* extracts the directory extension information of the MOT directory and the MOT header of each directory entry and delivers the extracted information to the TPEG decoder 3*b*. Further, each traffic information file having a binary or markup language format from each object is also extracted by the MOT decoder 3*a* and delivered to the TPEG decoder 3*b*.

When additional information required for decoding the traffic information is contained in the MOT directory, the information is also delivered to the TPEG decoder 3*b*. As discussed above, the TPEG decoder 3*b* determines the decodability of the traffic information in binary data (or markup language data) file based on the version and file type information carried by the parameter in the extracted directory extension, and determines each file either to be decoded for utilizing traffic the information or to be used for updating pre-interpreted traffic information from among extracted files based on information about each file embedded in each MOT header. In addition, the traffic information in the determined file (a merged file from file fragments when the determined files are file fragments) is interpreted in accordance with the identified file type information.

Further, when the received traffic information data is binary data, the TPEG decoder 3 interprets each TPEG message in a file and delivers required information and/or control signals in accordance with the content of the message to the navigation engine 5. In more detail, the TPEG decoder 3 extracts the date/time in the message management container of each TPEG message and message occurrence time, and identifies a succeeding container (for example, a CTT, RTM Event container) by using the information of the 'message element'.

If the succeeding container turns out to be a CTT event container, the information obtained from the container is delivered so the navigation engine 5 can display traffic information to the driver. In addition, the location information corresponding to currently delivered traffic information is obtained from a succeeding TPEG location container, and the location information, depending on the type information of the TPEG location container, can be either location coordinates (latitude and longitude) of a start position and end position or a link, namely, a link ID assigned to a road segment.

When the navigation terminal is equipped with the storage unit 4, the navigation engine 5 finds the link location about which the received information is created with reference to information on each link and node stored in the storage unit 4. If needed, the navigation engine 5 converts the coordinates of the link into the link ID or vice versa.

In addition, the navigation engine 5 reads a part of the electronic map centered on the position coordinates received from the GPS module 8 from the storage unit 4 and displays the map on the LCD panel 7 via the LCD drive 6. Further, a particular graphic symbol is displayed at the location corresponding to current position on the LCD panel 7.

Also, the navigation engine 5 displays traffic information received from the decoder 3 (e.g., an average speed information of a link) at a location corresponding to the coordinate or link ID delivered via the location container following the container delivering the average speed information. In addition, upon the user's request, the navigation engine 5 displays the travel time in a link and degree of congestion received from the decoder 3 on the LCD panel 7 instead of or with the average speed in a link.

Thus, the present invention allows the driver to arrive at a destination in a shorter amount of time by providing estimated congestion and travel time information for the driver and effectively disperses the amount of traffic in big cities, thereby promoting the effective use of the road resources. In particular, because the traffic information is provided via file transfer, the bandwidth of a transfer channel is reduced because the data overhead imposed on each frame unit is decreased. Further, the number of transmitted files is reduced when the MOT directory is utilized.

The foregoing description of a preferred embodiment of the present invention has been presented for purposes of illustration. Thus, those skilled in the art may utilize the invention and various embodiments with improvements, modifications, substitutions, or additions within the spirit and scope of the invention as defined by the following appended claims.

The invention claimed is:

1. A method for providing traffic information to a traffic information receiving apparatus, the method comprising:

providing information to a receiving unit including an object of a first type having a file including the traffic information and an object of a second type including information about the file and information about a traffic information service providing the file;

extracting information via a first decoder about a traffic information service and information about each file from a received object of the second type; and determining a decodability of the traffic information embedded in each file via a second decoder based on the extracted information about the traffic information service.

2. The method of claim 1, wherein the object of the first type includes a header core, a header extension and a body that encapsulates the file, and the object of the second type includes a directory extension containing at least one parameter and directory entries including a MOT header that is a duplicate of the header core and the header extension in the object of the first type.

3. The method of claim 2, wherein the directory extension contains a parameter identifying version information about the traffic information service, synch information specifying a time for synchronizing traffic information and a type information indicating a type of the file.

4. The method of claim 3, wherein the type information indicates whether the file is a binary data file or a markup language data file.

5. The method of claim 2, wherein the header extension of the MOT header contains a first parameter identifying version information of a transmitter side that transmitted the file and a second parameter indicating that the identifying version information exist in the first parameter.

6. The method of claim 1, wherein a number of directory entries corresponds to a number of objects of the first type.

7. The method of claim 1, wherein a filename of the file includes an identification assigned to the traffic information service providing the traffic information, a service component identifier, a file number and delimiters.

8. The method of claim 1, further comprising:

organizing the object of the first type and the object of the second type in a single object and transmitting the single object to a navigation reception terminal.

9. The method of claim 1, further comprising:

receiving the provided information via a navigation reception terminal; and extracting the file, the information about the file and the information about the traffic information service providing the file.

10. The method of claim 9, further comprising:

determining how the file is to be decoded;

decoding the file based on the determining step; and providing the decoded information contained in the file to a user of the navigation reception terminal.

11. The method of claim 1, further comprising:

determining whether each file from among the extracted files is either to be decoded for utilizing traffic information or to be used for updating traffic information based on the extracted information about each file.

12. An apparatus for receiving traffic information, the apparatus comprising:

a receiving unit configured to received information including an object of a first type having a file including the traffic information and an object of a second type including information about the file and information about a traffic information service providing the file;

a first decoder configured to extract the file from the object of the first type, and the information about the file and the information about the traffic information service from the object of the second type; and a second decoder configured to determine a decodability of the traffic information of the file based on the extracted information about the traffic information service.

13. The apparatus of claim 12, wherein the object of the first type includes a header core, a header extension and a body that encapsulates the file, and the object of the second type includes a directory extension containing at least one parameter and directory entries including a MOT header that is a duplicate of the header core and the header extension in the object of the first type.

14. The apparatus of claim 13, wherein the header extension of the MOT header contains a first parameter identifying version information of a transmitter side that transmitted the file and a second parameter indicating that the identifying version information exist in the first parameter.

15. The apparatus of claim 12, wherein a number of directory entries corresponds to a number of objects of the first type.

16. The apparatus of claim 15, wherein the directory extension contains a parameter identifying version information about the traffic information service, synch information specifying a time for synchronizing traffic information and a type information indicating a type of the file.

17. The apparatus of claim 16, wherein the type information indicates whether the file is a binary data file or a markup language data file.

18. The apparatus of claim 12, wherein a filename of the file includes an identification assigned to the traffic information service providing the traffic information, a service component identifier, a file number and delimiters.

19. The apparatus of claim 12, further comprising:

a location detector configured to obtain information about a current location of the apparatus; and a navigation engine configured to store the extracted traffic information and to display a part of the traffic information corresponding to road segments belonging to a particular region around the obtained current location.

20. The apparatus of claim 12, wherein the second decoder is further configured to determine whether the file is to be used for providing traffic information or used for updating traffic information.

* * * * *